US005799416A

United States Patent [19]

Prober

[11] Patent Number: 5,799,416

[45] Date of Patent: Sep. 1, 1998

[54] ANTI-BLISTER SHOE GRIPS

[76] Inventor: Gregory Prober, P.O. Box 68, South Huntington, N.Y. 11746

[21] Appl. No.: 719,470

[22] Filed: Sep. 25, 1996

[51] Int. Cl.[6] ..... A43B 23/28

[52] U.S. Cl. ..... 36/58.6; 36/58.5

[58] Field of Search ..... 36/58.5, 58.6

[56] References Cited

U.S. PATENT DOCUMENTS

| | | | |
|---|---|---|---|
| 369,766 | 9/1887 | Barney | 36/58.6 |
| 395,271 | 12/1888 | Benedict | 36/58.6 |
| 1,524,805 | 2/1925 | Anderson | 36/58.6 |
| 1,966,179 | 7/1934 | Lesch | 36/58.6 |
| 3,006,084 | 10/1961 | Le Compte | 36/58.6 X |

FOREIGN PATENT DOCUMENTS

| | | |
|---|---|---|
| 13761 | 4/1917 | France . |
| 364732 | 1/1932 | United Kingdom . |

*Primary Examiner*—Ted Kavanaugh

[57] ABSTRACT

The present invention relates to a anti-blister shoe grip (10) which is installed into the back of a dress shoe to prevent heel abrasion and the forward pressure on the toes caused by padding. The anti-blister shoe grip (10) is installed through a shoe back inside (14BI). A first anti-blister shoe grip (110) is essentially the same as the anti-blister shoe grip (10) but is sewn onto a shoe back inside (14BI).

11 Claims, 4 Drawing Sheets

ANTI-BLISTER SHOE GRIPS

BACKGROUND OF THE INVENTION

1. Field of the Invention

The present invention relates to shoes. More particularly, the present invention relates to a shoe lining having protective grip which functions to reduce abrasive to a users foot.

2. Description of the Prior Art

For decades shoe manufacturers and shoe accessory suppliers have attempted to develop shoe back part designs which would protect heel skin from blisters caused by shoe heel back curves pinching into unprotected skin.

In certain types of shoes such as Dress heels, the back curve of the shoe must be pinched in at a top distal end to keep shoes from slipping off while a user is walking. Unfortunately, a very sizable proportion of the population cannot wear dressy shoes without some kind of protection because their skin is too sensitive to the abrasive rubbing effect of the back curves of the shoes against the foot. Many users are restricted to wearing only sneakers or moccasins which have a top-line collar padding.

Some users purchase a shoe which is a half-size larger having an instep strap. However, most people who cannot wear dressy shoes prefer to attach/insert suede heel-grips wich combined with a soft padding. The heel-grips are 2–3 mm thick inserts which push feet 2–3 mm forward, making the front portion of the shoe tight and uncomfortable and creates a large space between the feet and the shoes at the bottom of the heels.

Therefore, there exists a need for a novel and innovative method of construction of shoes which overcomes the discomfort associated with the present technology.

Numerous innovations for Anti-blister Shoe Grips have been provided in the prior art that are described as follows. Even though these innovations may be suitable for the specific individual purposes to which they address, they differ from the present invention as hereinafter contrasted.

In U.S. Pat. No. 4,856,209, titled Walking Shoe With Padded Collar, invented by Kenyon, an improved walking shoe which is constructed of a sole assembly and a shoe upper is disclosed. The upper has an independently attached padded collar with grommet lacing to provide support and protection principally for the ankle and instep regions of the foot.

The patented invention differs from our invention because the patented invention provides for a collar stitched to the upper portion of a shoe to wrap around the upper portion of the heel of the user. The collar of the patented invention is described as having a uniform degree of thickness throughout. The collar of the Kenyon invention is principally designed for increased ankle support during athletic activity. Our invention, in contrast, provides a plurality of grips of differing thickness for the purpose of better keeping the user's foot within the shoe, while accomplishing much greater Comfort than the traditional design, and enhancing stability.

In U.S. Pat. No. 4,559,722, titled Construction Of Upper For Athletic Shoe, invented by Norton, an athletic shoe for runners includes a backtab at the upper heel/counter portion of the shoe which extends somewhat along both the lateral and medial sides of the shoe. The backtab is a cushioning member and includes a notch to accommodate the Achilles tendon to reduce stress and pressure on the tendon which may result in aggravation or injury.

The patented invention differs from our invention firstly because the patented invention is specifically designed for runners and joggers, and specially adapted for protecting the Achilles tendon from injury. Thus, the invention is only described for use in athletic shoes. In contrast, our invention is not primarily designed to prevent injury, but instead to comfortably keep the heel inside the shoe, absent blisters or skin irritation. Completely unlike the patented invention which provides a cut-out for the tendon to sit in, our invention incorporates grips of various degrees of thickness to hold the heel in a comfortable but stable position.

In U.S. Pat. No. 4,705,025, titled Heel Padding, invented by Dedo, a heel pad comprising a sheet of porous material having a hemispherical portion for placement on the heel, first and second opposes flap portions extending upwardly from the hemispherical portion and a central portion connecting the first and second flap portions. The pad has third and fourth opposed flap portions extending downwardly from the hemispherical portion, and a central portion connecting the third and fourth opposed flap portions. The third and fourth opposed flap portions are adapted to overlap upper portions over lower portions of the first and second flap portions, with the first and second flap portions facing each other, and with the third and fourth opposed flap portions facing each other in the formed sheet.

The patented invention differs from our invention because the patented invention uses a pad that is inserted in the shoe in a vertical position, whereby the lower portion is secured below the user's foot, and the upper portion extends out from under the foot to act as a buffer between the heel and the back of the shoe. Your invention describes a different embodiment in which the pad or insert is secured horizontally to wrap around the upper portion of the ankle or heel from side to side. Moreover, your invention does not teach the use of four flap portions, but instead uses individual grips of medium or high density in specific stress areas of the foot.

In U.S. Pat. No. 4,662,088, titled Achilles Tendon Protection And Support Pad, invented by Autry, a pad for the protection of the Achilles Tendon is provided for an over the ankle shoe. The pad is formed of resiliently yieldable material and is disposed between the exterior upper of the shoe and an interior linear. The pad extends vertically from the top of the shoe downward sufficiently to cover the most exteriorly prominent section of the tendon, and extends horizontally at least far enough to protect the tendon from injury, while allowing for flexing and movement.

The patented invention differs from our invention because the patented invention, much like the previously mentioned Norton invention, is specifically designed for runners and joggers, and specially adapted for protecting the Achilles tendon from injury. Again, the invention is only described for use in athletic shoes. Our invention can be used in any type of shoe, and is particularly useful in otherwise uncomfortable dress type shoes. Moreover, the user of the invention by Autry may be expected to feel some discomfort if there is too much space between the heel of the user and the shoe, or if the user's toes may be impacted in the front of the shoe sneaker.

In U.S. Pat. No. 5,313,717, titled Reactive Energy Fluid Filled Apparatus Providing Cushioning, Support, Stability, And A Custom Fit In A Shoe, invented by Allen, a reactive energy fluid filled cushioning apparatus in a shoe is comprised of one or more anatomically shaped fluid filled bladders that are positioned in the forefoot, arch and/or heel areas of the shoe. The bladders assume a complimentary custom fitting configuration to the contours of a foot. In other embodiments, the bladders are positioned separate from each other in the forefoot, arch and heel areas and are connected in fluid communication by conducting channels, or the bladders are positioned independent from each other in the forefoot, arch and heel areas of the shoe.

The patented invention differs from your invention because the patented invention incorporates a unique design including bladders of fluids within the shoe, and particularly below the user's foot. Such a design is described as increasing the user's comfort by softening the impact of the foot against the ground, thus preventing damage or skin irritation to the bottom of the foot and toes. Your invention does not describe any fluid means whatsoever, but instead utilizes protective grips at the upper portion of the back of the user's ankle, wherein the grips are of a medium density at the back of the heel, and at a higher density adjacent thereto. Thus, whereas the patented invention is designed to enhance comfort to the bottom of the foot and toe areas, our invention seeks to prevent blisters or skin irritation at the user's heels, particularly in high-heel or dress type shoes.

SUMMARY OF THE INVENTION

The present invention is encompasses a new shoe construction and method of shoemaking in which the back curve portion does not pinch into the heel of the foot. The present invention comprises a protective grip made out of a medium (thicker) and higher (thinner) density of the urethane, latex and/or other materials which maintains the shoes firmly on the foot without hurting the heel skin.

The present invention requires lasts with a straighter back curve (or putting an increase on the last) as well as medium and higher density grips inserted into the counter lining near the top-line in the back. The shoes would then be produced with the grips already inside the heel of the shoe or conversely in another embodiment, an insert which could be sewn into an inside heel portion.

The types of problems encountered in the prior art are the back of the shoe needs to be pinched in to prevent the shoe from falling off. This pinching causes abrasion to the heel area of the foot requiring a pad to be inserted into the shoe protecting the wearer's ankle.

In the prior art, unsuccessful attempts to solve this problem were attempted namely: eliminating the pinched in area of the shoe. Elimination of the pinched in area results in a unsecured attachment of the shoe to the user's foot. An additional attempt to resolve this problem by adding padding results in the toes of the user being pushed forward jamming the toe into the toe. The present invention solves this problem by building in grips inside the shoe lining which firmly hold the foot with out jamming the toes into the front part of the foot. The grip permits the rear of the shoe to be relaxed reducing the abrasive wear on the user's heel.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawings.

DESCRIPTION OF THE PREFERRED EMBODIMENT

Figure 1A:
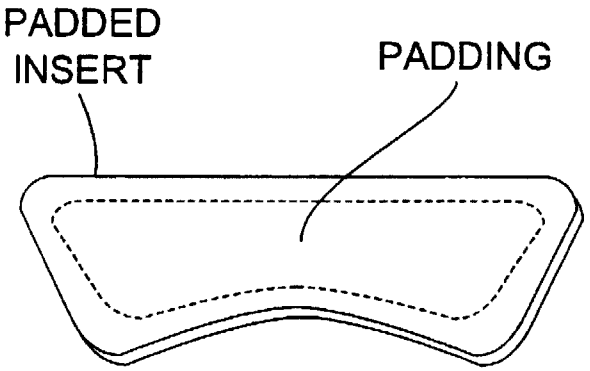
FIG. 1A (PRIOR ART)
FIG. 1A is a top view of a prior art padded insert exhibiting an outer envelope containing padding therein.
Figure 1:
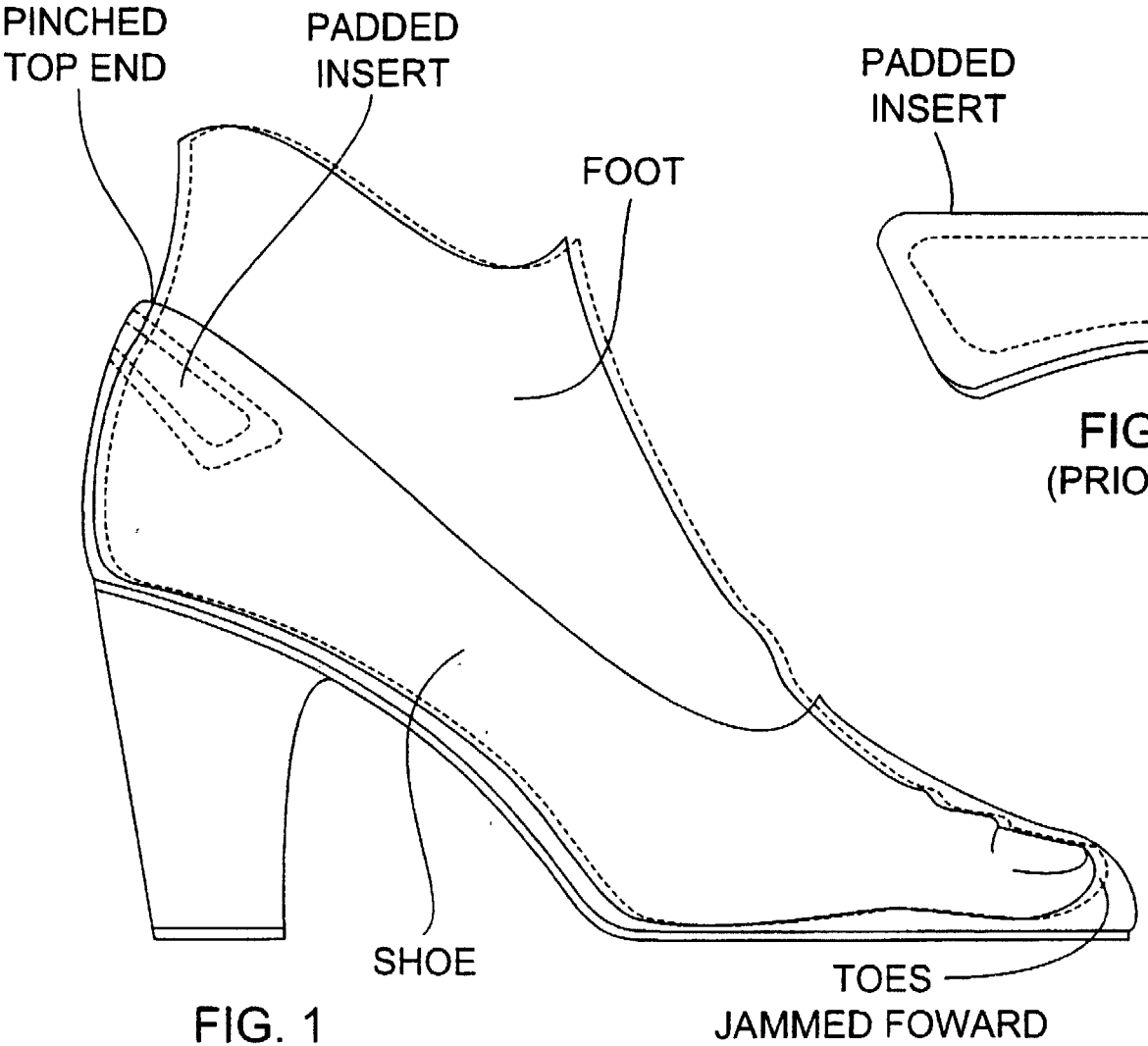
FIG. 1 (PRIOR ART)
FIG. 1 is a right side view of a prior art padded insert affixed to an inside of top of a pinched end of a shoe.

Firstly, referring to FIG. 1 which is a is a right side view of a prior art padded insert affixed to an inside of top of a pinched end of a shoe.

Secondly, referring to FIG. 1A is a top view of a prior art padded insert exhibiting an outer envelope containing padding therein.

Figure 2A:
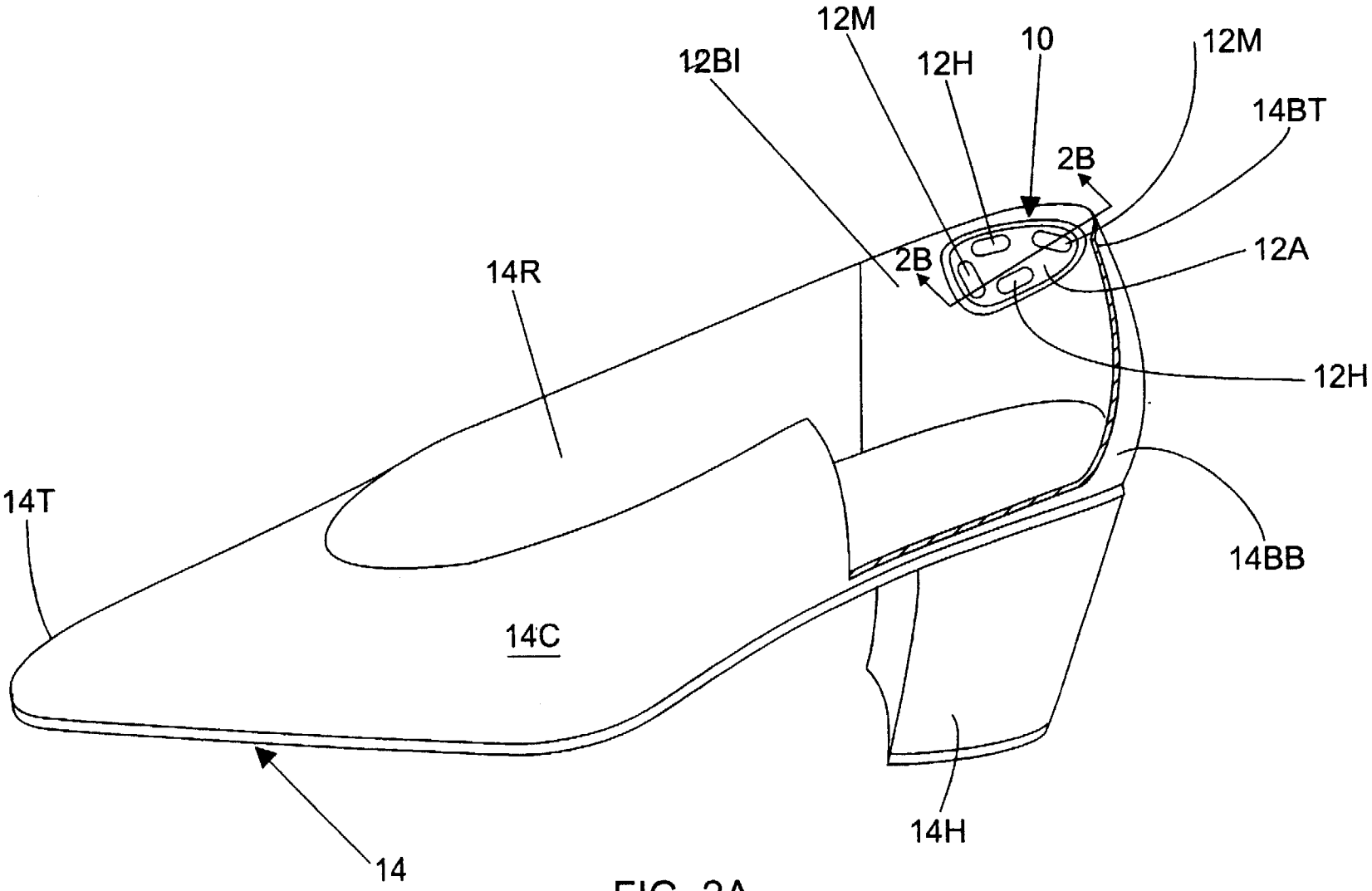
FIG. 2A is a left side partial cross-sectional perspective view of an anti-blister shoe grip affixed to an inside top end of a shoe.

Thirdly, referring to FIG. 2A which is a left side partial cross-sectional perspective view of an anti-blister shoe grip (10) affixed to an inside top end of a shoe (14) having the following features: first grip (12H), shoe (14), shoe toe (14T), shoe left side (14L), shoe right side (14R), shoe heel (14H), shoe back top (14BT), shoe back bottom (14BB), shoe back inside (14BI), and shoe back outside (14BO).

A anti-blister shoe grip (10) comprises a second grip (12M) and a at least two first grip (121) securely attached thereto. The anti-blister shoe grip (10) is securely attached to a shoe (14) at an shoe back inside (14BI). The shoe (14) comprises a shoe toe (14T) at a front distal end. The shoe toe (14T) is securely fastened at a left side to a proximal end of a shoe left side (14L). A distal end of the shoe left side (14L) is securely attached to a proximal end of a shoe right side (14R). The distal end of the shoe right side (14R) is securely attached to the right side of the shoe toe (14T). The shoe (14) further comprises a shoe heel (14H). The shoe heel (14H) is securely attached to a rear, lower, proximal side of the shoe (14).

The shoe (14) consists of a shoe back top (14BT) on a upper distal edge. The shoe (14) further consists of a shoe back bottom (14BB) and a shoe back outside (14BO).

Figure 2B:
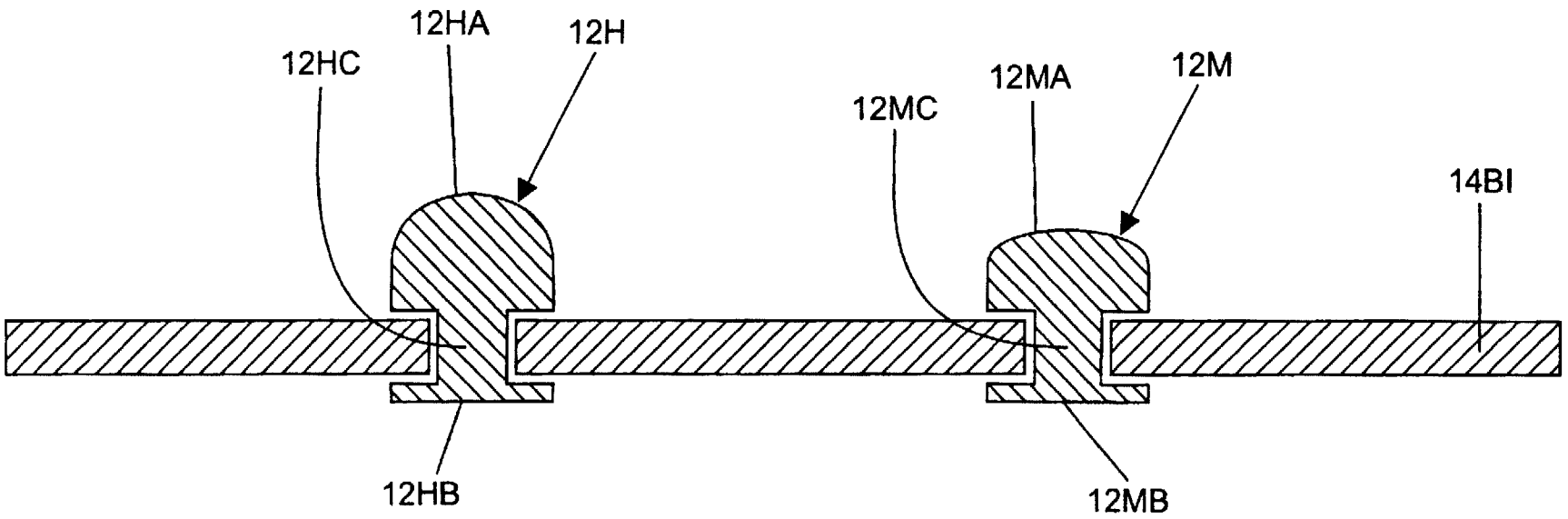
FIG. 2B is a cross-sectional view of an anti-blister shoe grip secured within a shoe back inside.

Now, referring to FIG. 2B which is a cross-sectional view of an anti-blister shoe grip (10) secured within a shoe back inside (14BI) having the following features: first grip (12H), first grip inner member (12HA), first grip outer member (12HB), first grip middle member (12HC), second grip (12M), second grip inner member (12MA), second grip outer member (12MB), and second grip middle member (12MC).

The at least two first grips (12H) comprises a first grip inner member (12HA) which is dome shaped having a diameter significantly greater than a first grip middle member (12HC). The first grip inner member (12HA) is securely attached to at inner end to a proximal end of a first grip middle member (12HC). A distal end of the first grip middle member (12HC) is securely attached to a proximal end of a first grip outer member (12HB). The first grip outer member (12HB) is significantly larger than the first grip middle member (12HC). The first grip outer member (12HB) prevents the at least two first grips (12H) from being extracted from the shoe back inside (14BI).

The second grip (12M) comprises a second grip inner member (12MA). A inner distal end of the second grip inner member (12MA) is securely attached to a proximal end of a second grip middle member (12MC). A distal end of the second grip middle member (12MC) is securely attached to a second grip outer member (12MB). The second grip outer member (12MB) and the second grip inner member (12MA) are significantly larger in diameter than the second grip middle member (12MC) to prevent the second grip (12M) from being extracted from the shoe back inside (14BI).

The at least two first grips (12H) are positioned between the at least two second grips (12M).

The at least two second grips (12M) are positioned between the at least two first grips (12H).

The at least two first grips (12H) are positioned in vertical alignment to each other.

The at least two second grips (12M) are positioned in vertical alignment to each other.

The at least two first grips (12H) comprise a first grip inner member (12HA) connected to a first grip outer member (12HB) by a first grip middle member (12HC). The first grip outer member (12HB) is positioned between the shoe back inside (14BI) and a shoe back outside (14BO) and the first grip middle member (12HC) is positioned within an opening in the shoe back inside (14BI).

The at least two second grips (12M) comprise a second grip inner member (12MA) connected to a second grip outer member (12MB) by a second grip middle member (12MC). The second grip outer member (12MB) is positioned between the shoe back inside (14BI) and a shoe back outside (14BO). The second grip middle member (12MC) is positioned within an opening in the shoe back inside (14BI).

The first grip inner member (12HA) is configured in a shape selected from a group consisting of round, oval, elliptical, square, rectangle, triangle, and polygonal.

The second grip inner member (12MA) is configured in a shape selected from a group consisting of round, oval, elliptical, square, rectangle, triangle, and polygonal.

The at least two first grips (12H) and the at least two second grips (12M) are manufactured from a material selected from a group consisting of plastic, plastic composite, rubber and rubber composite.

The at least two first grips (12H) and the at least two second grips (12M) are manufactured from LATEX (TM).

The at least two first grips (12H) and the at least two grips (12M) are manufactured from polyurathane.

Figure 3:
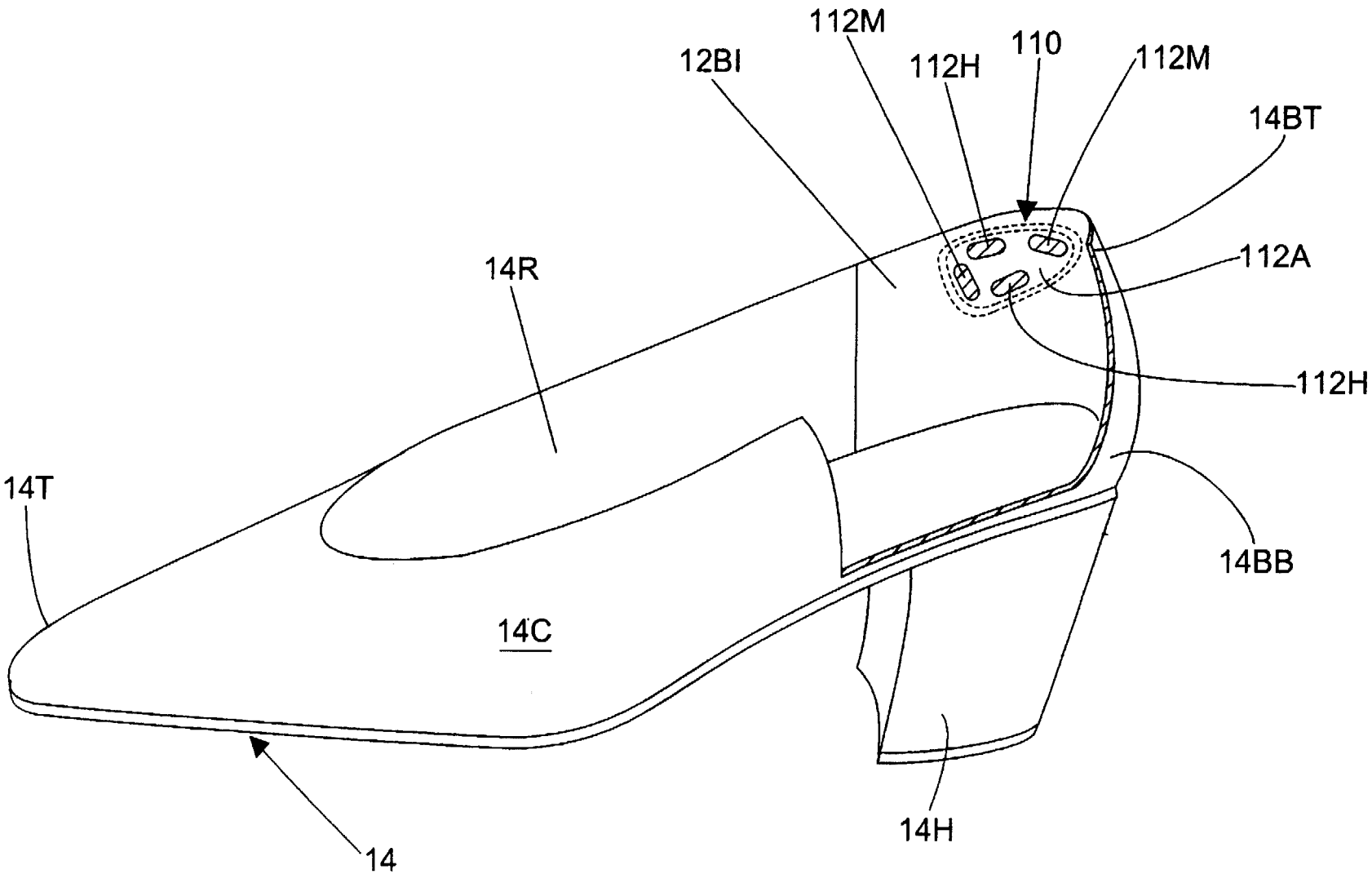
FIG. 3 is a left side partial cross-sectional perspective view of an first anti-blister shoe grip (110) affixed to a shoe back inside of a shoe.

Thirdly referring to FIG. 3 which is a left side partial cross-sectional perspective view of an first anti-blister shoe grip (110) affixed to a shoe back inside (14BI) of a shoe (14) having the following features: shoe toe (14T), shoe left side (14L), shoe right side (14R), shoe heel (14H), shoe back top (14BT), shoe back bottom (14BB), shoe back outside (14BO), first anti-blister shoe grip (110), first grip backing (112A), first grip (112H), first grip inner member (112HA), first grip outer member (112HB), first grip middle member (112HC), second grip (112M), second grip inner member (112MA), second grip outer member (112MB), and second grip middle member (112MC).

A first anti-blister shoe grip (110) comprises a second grip (12M) and a first grip backing (112A) securely attached thereto. The first anti-blister shoe grip (110) is securely attached to a shoe (14) at an shoe back inside (14BI). The shoe (14) comprises a shoe toe (14T) at a front distal end. The shoe toe (14T) is securely fastened at a left side to a proximal end of a shoe left side (14L). A distal end of the shoe left side (14L) is securely attached to a proximal end of a shoe right side (14R). The distal end of the shoe right side (14R) is securely attached to the right side of the shoe toe (14T). The shoe (14) further comprises a shoe heel (14H). The shoe heel (14H) is securely attached to a rear, lower, proximal side of the shoe (14).

The shoe (14) consists of a shoe back top (14BT) on a upper distal edge. The shoe (14) first her consists of a shoe back bottom (14BB) and a shoe back outside (14BO).

A first anti-blister shoe grip (110) is sewable attached into a shoe back top (14BT) of a shoe back inside (14BI) of a shoe (14). The first grip (112) comprises a first grip backing (112A) having at least two first grips (112H) securely attached thereto. At least two second grips (112M) are securely attached to the shoe back inside (14BI) which is positioned on the shoe back top (14BT). The at least two first grips (112H) and the at least two second grips (112M) function to allow the shoe (14) to be manufactured with a comfortable straight non-pinched shoe back top (14BT) retaining non-slip functionality.

The at least two first grips (112H) are positioned between the at least two second grips (112M).

The at least two second grips (112M) are positioned between the at least two first grip (112H).

The at least two first grips (112H) are positioned in vertical alignment to each other.

The at least two second grips (112M) are positioned in vertical alignment to each other.

The at least two first grips (112H) comprise a grip inner member (12HA) connected to a grip outer member (12HB) by a grip middle member (12HC). The grip outer member (12HB) is positioned between the shoe back inside (14BI) and a shoe back outside (14BO). The grip middle member (12HC) is positioned within an opening in the first grip backing (112A) which is sewn into the shoe back inside (14BI).

The at least two second grips (12M) comprise a second grip inner member (12MA) connected to a second grip outer member (12MB) by a second grip middle member (12MC). The second grip outer member (12MB) is positioned between the shoe back inside (14BI) and a shoe back outside (14BO). The second grip middle member (12MC) is positioned within an opening in the first grip backing (112A) which is sewn into the shoe back inside (14BI).

The first grip inner member (12HA) is configured in a shape selected from a group consisting of round, oval, elliptical, square, rectangle, triangle, and polygonal.

The second grip inner member (12MA) is configured in a shape selected from a group consisting of round, oval, elliptical, square, rectangle, triangle, and polygonal.

The at least two first grip (112H) and the at least two second grips (112M) are manufactured from a material selected from a group consisting of plastic, plastic composite, rubber and rubber composite.

The at least two first grip (112H) and the at least two second grips (112M) are manufactured from LATEX (TM).

The at least two first grips (112H) and the at least two second grips (112M) are manufactured from polyurathane.

It will be understood that each of the elements described above, or two or more together, may also find a useful application in other types of constructions differing from the type described above.

While the invention has been illustrated and described as embodied in a antiblister shoe grip, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

What is claimed is:

1. An anti-blister shoe grip (10) positioned on shoe back top (14BT) of a shoe back inside (14BI) of a shoe (14), the anti-blister shoe grip (10) comprising:

A) at least two first grips (12H) securely attached to the shoe back inside (14BI) positioned on the shoe back top (14BT), the at least two first grips (12H) protrude inward from the shoe back inside a first distance, and B) at least two second grips (12M) securely attached to the shoe back inside (14BI) positioned on the shoe back top (14BT), the at least two second grips (12M) protrude inward from the shoe back inside a second distance which is less than the first distance, thereby the first grips have a thickness greater than the second grips the at least two second grips (12M) are positioned between the at least two first grips (12H), the at least two first grips (12H) are positioned in a substantial vertical alignment to each other, the at least two second grips (12M) are positioned in vertical alignment to each other, the at least two first grips (12H) comprise a first grip inner member (12HA) connected to a first grip outer member (12HB) by a first grip middle member (12HC), the first grip outer member (12HB) is positioned between the shoe back inside (14BI) and a shoe back outside (14BO), the first grip middle member (12HC) is positioned within an opening in the shoe back inside (14BI), the at least two second grips (12M) comprise a second grip inner member (12MA) connected to a medium grip outer member (12MB) by a medium grip middle member (12MC), the medium grip outer member (12MB) is positioned between the shoe back inside (14BI) and a shoe back outside (14BO), the medium grip middle member (12MC) is positioned within an opening in the shoe back inside (14BI), the at least two first grips (12H) and the at least two second grips (12M) function to allow the shoe (14) to be manufactured with a comfortable straight non-pinched shoe back top (14BT) retaining non-slip functionality.

2. The anti-blister shoe grip (10) as described in claim 1, wherein the at least two first grips (12H) are positioned between the at least two second grips (12M).

3. The anti-blister shoe grip (10) as described in claim 1, wherein the first grip inner member (12HA) is configured in a shape selected from a group consisting of round, oval, elliptical, square, rectangle, triangle, and polygonal.

4. The anti-blister shoe grip (10) as described in claim 1, wherein the second grip inner member (12MA) is configured in a shape selected from a group consisting of round, oval, elliptical, square, rectangle, triangle, and polygonal.

5. The anti-blister shoe grip (10) as described in claim 1, wherein the at least two first grips (12H) and the at least two second grips (12M) are manufactured from a material selected from a group consisting of plastic, plastic composite, rubber and rubber composite.

6. The anti-blister shoe grip (10) as described in claim 5, wherein the at least two first grips (12H) and the at least two second grips (12M) are manufactured from polyurathane.

7. A first anti-blister shoe grip (110) sewable into a shoe back top (14BT) of a shoe back inside (14BI) of a shoe (14), the first grip (112) comprising:

A) a first grip backing (112A);

B) at least two first grips (112H) securely attached to the first grip backing (112A) the at least two first grips protrude outward from the first grip backing a first distance; and C) at least two second grips (112M) securely attached to the shoe back inside (14BI) positioned on the shoe back top (14BT) the at least two second grips protrude outward from the first grip backing a second distance which is less than the first distance, thereby the first grips have a thickness greater than the second grips, the at least two first grips (112H) are positioned between the at least two second grips (112M), the at least two first grips (112H) are positioned in substantially vertical alignment to each other, the at least two second grips (112M) are positioned in vertical alignment to each other, the at least two first grips (112H) comprise a first grip inner member (12HA) connected to a first grip outer member (12HB) by a first grip middle member (12HC), the first grip outer member (12HB) is positioned between the shoe back inside (14BI) and a shoe back outside (14BO), the first grip middle member (12HC) is positioned within an opening in the first grip backing (112A) which is sewn into the shoe back inside (14BI), the at least two second grips (112M) comprise a second grip inner member (12MA) connected to a second grip outer member (12MB) by a second grip middle member (12MC), the second grip outer member (12MB) is positioned between the shoe back inside (14BI) and a shoe back outside (14BO), the second grip middle member (12MC) is positioned within an opening in the first grip backing (112A) which is sewn into the shoe back inside (14BI), the at least two first grips (112H) and the at least two second grips (112M) which function to allow the shoe (14) to be manufactured with a comfortable straight non-pinched shoe back top (14BT) retaining non-slip functionality.

8. The first anti-blister shoe grip (110) as described in claim 7, wherein the first grip inner member (12HA) is configured in a shape selected from a group consisting of round, oval, elliptical, square, rectangle, triangle, and polygonal.

9. The first anti-blister shoe grip (110) as described in claim 7, wherein the second grip inner member (12MA) is configured in a shape selected from a group consisting of round, oval, elliptical, square, rectangle, triangle, and polygonal.

10. The first anti-blister shoe grip (110) as described in claim 7, wherein the at least two first grips (112H) and the at least two second grips (112M) are manufactured from a material selected from a group consisting of plastic, plastic composite, rubber and rubber composite.

11. The first anti-blister shoe grip (110) as described in claim 10, wherein the at least two first grips (112H) and the at least two second grips (112M) are manufactured from polyurathane.

* * * * *